US006739818B2

(12) United States Patent
Aguirre

(10) Patent No.: US 6,739,818 B2
(45) **Date of Patent: *May 25, 2004**

(54) POST PRINT FINISHING DEVICE WITH SPIRAL BINDER

(75) Inventor: Jaime De La Torre Aguirre, Zapopan Jaslisco (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 49 days.

This patent is subject to a terminal disclaimer.

(21) Appl. No.: 10/180,479

(22) Filed: Jun. 25, 2002

(65) Prior Publication Data

US 2003/0235484 A1 Dec. 25, 2003

(51) Int. Cl.[7] ..... B42B 5/10

(52) U.S. Cl. ..... 412/39; 270/52.18; 270/58.07; 412/1; 412/6; 412/9; 412/18; 412/33

(58) Field of Search ..... 412/1, 3, 6, 9, 412/18, 19, 20, 25, 33, 38, 39, 40; 270/52.18, 58.01, 58.07, 58.08, 58.09

(56) References Cited

U.S. PATENT DOCUMENTS

| | | | | |
|---|---|---|---|---|
| 5,215,298 A | * | 6/1993 | Stemmle et al. | 271/65 |
| 5,871,323 A | * | 2/1999 | Clark | 412/4 |
| 5,931,624 A | * | 8/1999 | Naruse | 412/8 |
| 6,171,044 B1 | | 1/2001 | De La Torre | |
| 6,601,840 B2 | * | 8/2003 | Boss et al. | 270/58.08 |
| 2003/0161704 A1 | * | 8/2003 | Trovinger | 412/25 |

FOREIGN PATENT DOCUMENTS

JP P2003-73023 * 3/2003

* cited by examiner

*Primary Examiner*—Monica S. Carter

(57) ABSTRACT

The present invention is directed to a post print finishing device that incorporates a spiral binder module into the post print handling and finishing functions. In one exemplary embodiment of the invention, the binder module binds sheets together by inserting a metal piece that serves as the binder and then bends the metal so as to function as a spiral binder. An accumulator module is included to stack the sheets, present the sheets to the binder for binding and then discharges the bound stack to an output bin.

12 Claims, 13 Drawing Sheets

POST PRINT FINISHING DEVICE WITH SPIRAL BINDER

FIELD OF THE INVENTION

The present invention is directed to a post print finishing device in which a spiral binding is used to bind a printed documented.

BACKGROUND OF THE INVENTION

Current devices and methods for printing and binding media sheets involve printing the desired document on a plurality of media sheets, assembling the media sheets into a stack, and separately stapling, clamping, gluing and/or sewing the stack. In addition to imaging material used to print the document, each of these binding methods requires separate binding materials, increasing the cost and complexity of binding. Techniques for binding media sheets using imaging material are known in the art. These techniques generally involve applying imaging material such as toner to defined binding regions on multiple sheets, assembling the media sheets into a stack, and reactivating the imaging material, causing the media sheets to adhere to one another.

In addition, certain binding applications are prepared so that the spine of the binding is done in a loose manner that allows the stack to be opened to a flat position. Typically, spiral bound stacks are desirable to achieve this result. However, heretofore there has been no spiral binder device for use in the post print finishing stage of binding a stack of sheets with a desirable spiral binder.

Accordingly, what is needed is a post print finishing device that can perform spiral binding on a stack of sheets.

SUMMARY OF THE INVENTION

Accordingly, the present invention is directed to a post print finishing device that incorporates a spiral binder into the post print handling and finishing functions. In one exemplary embodiment of the invention, the finishing device includes an accumulator module and a binder module. The binder module binds sheets together utilizing a metal piece that serves as the binder and bending the metal so as to function as a spiral binder. The accumulator module stacks the sheets, presents the sheets to the binder for binding and then discharges the bound stack to the output bin. An automated method of binding the stack with a spiral binding is also disclosed.

DESCRIPTION OF THE DRAWINGS

FIG. 3 shows a sheet routed to the upper/single sheet output bin. FIGS. 4–7 show a sheet routed to the stack of sheets in the accumulator in preparation for binding. FIGS. 8–10 show the stack routed to the binder, bound and then discharged to the lower/stacker output bin.

DETAILED DESCRIPTION OF THE INVENTION

The invention will be described with reference to the printer 10 and attached stacker 12 shown in FIG. 1. The invention may be implemented in any document production system in which it is necessary or desirable to use an inline spiral binder. Printer 10 and stacker 12, therefore, represent generally any suitable printing device (e.g., printers, copiers, and multi-function peripherals) and associated post print finishing device in which an inline spiral binder is used to bind a printed document.

Figure 1:
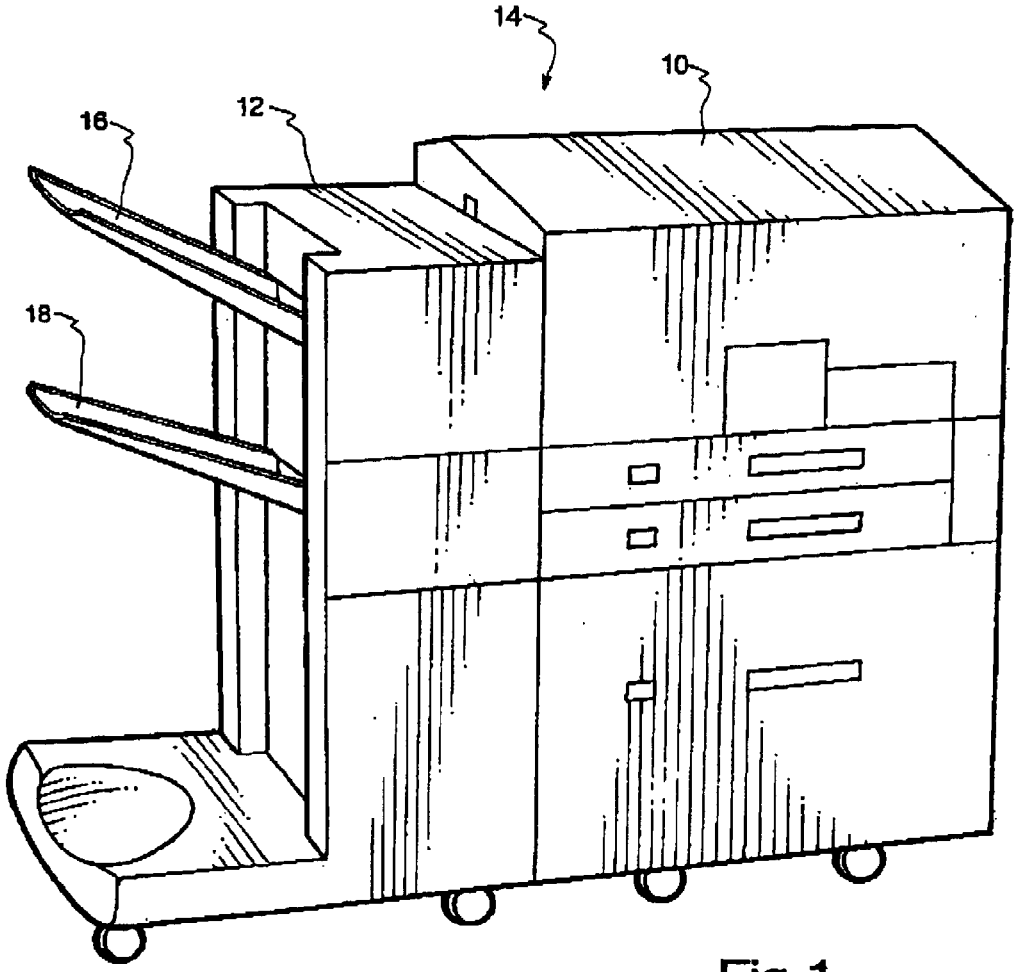
FIG. 1 is a perspective view of a printer and attached stacker illustrating one type of document printing and finishing system in which the invention may be implemented.

Referring to FIG. 1, printer 10 and stacker 12 together make up a document production system designated generally by reference number 14. Printed sheets are output by printer 10 to stacker 12 where they are routed to an upper/loose sheet output bin 16 or to a lower/stacker output bin 18. Unbound sheets are collected face up in loose sheet bin 16. Bound documents are collected face down in stacker bin 18.

Figure 2:
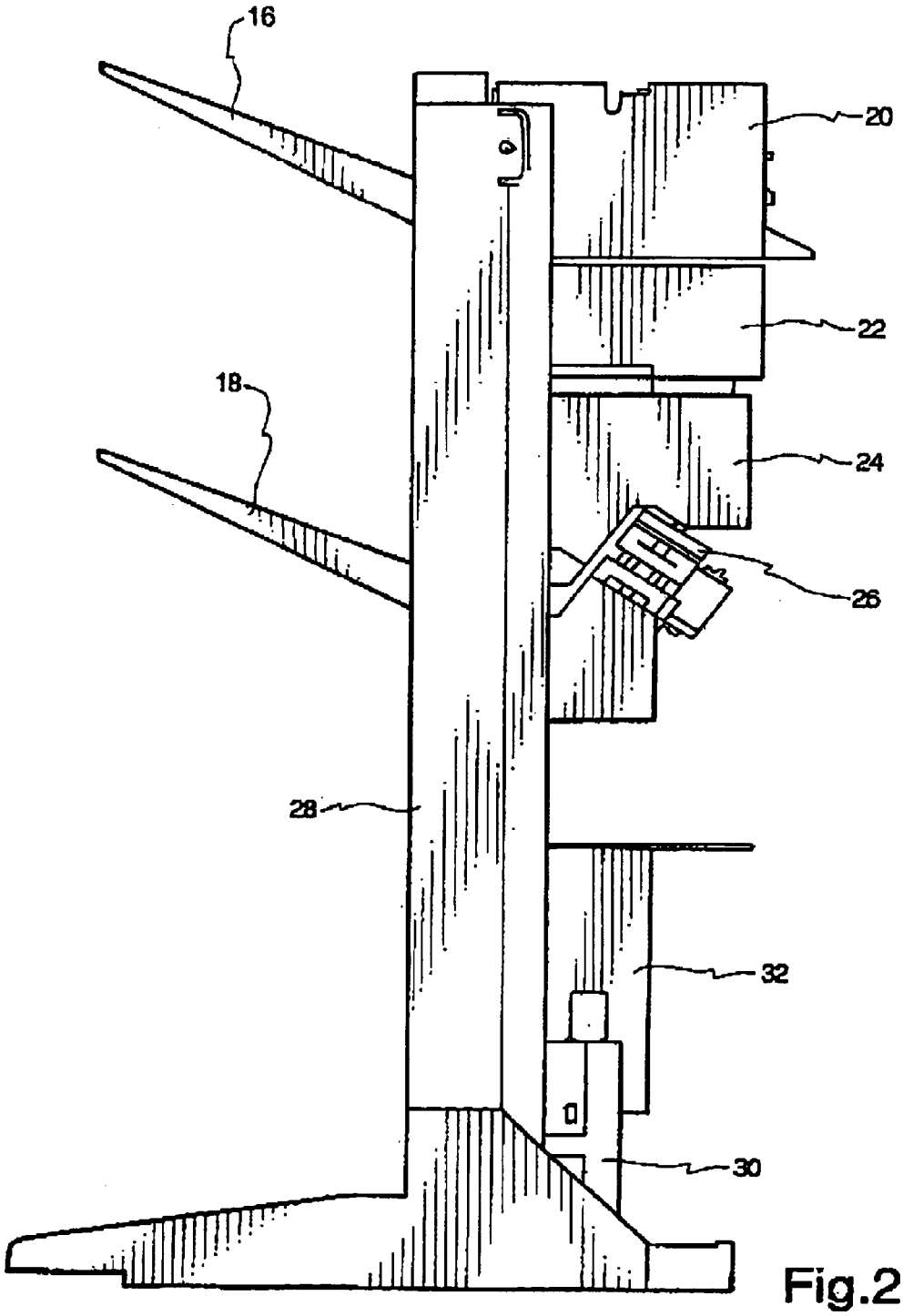
FIG. 2 is a side elevation view of a modular stacker constructed according to one embodiment of the invention showing the flipper, paper path, accumulator and binder modules.

A stacker 12 constructed according to one embodiment of the invention will now be described with reference to FIG. 2. FIG. 2 is a side elevation view looking into stacker 12 showing the flipper module 20, paper path module 22, accumulator module 24 and binder module 26. Each module is mounted to a frame 28. Frame 28, which forms the main body or "skeleton" of stacker 12, is made from sheet metal or other suitable structurally stable materials. A power supply 30 and controller 32 are mounted to the lower portion of frame 28. Power supply 30 and controller 32 are electrically connected to the operative components of modules 20, 22, 24 and 26. Controller 32 contains the electronic circuitry and programming necessary to control and coordinate various functions of the components in stacker 12. The details of the circuitry and programming of controller 32 are not particularly important to the invention as long as the controller design is sufficient to direct the desired functions as described below.

The modular design of stacker 12 shown in FIG. 2 is adapted from the Hewlett-Packard Company model C8085A stapler/stacker. Each module 20, 22, 24 and 26 is operatively coupled to but otherwise independent of the adjacent module. In the stacker of the present invention, the stapler module used in the C8085A stapler/stacker is replaced with binder module 26 and controller 32 is modified accordingly to control the operation of an inline spiral binder rather than a stapler.

For sheets that will be stacked, bound and output to bin 18, flipper 20 makes the leading edge of each sheet output by printer 10 the trailing edge for routing to paper path 22 and accumulator 24. Flipping the sheets in this manner from face up to face down is necessary to properly stack the sheets in accumulator 24 prior to binding. Paper path 22 moves each sheet face down to accumulator 24 where the sheets are collected, registered, moved to binder 26 (when binding is desired) and then output to bin 18 (bound or unbound). Binder 26 performs the inline spiral binding of the sheets collected in accumulator 24 to bind the sheets together along a common edge.

Figure 3:
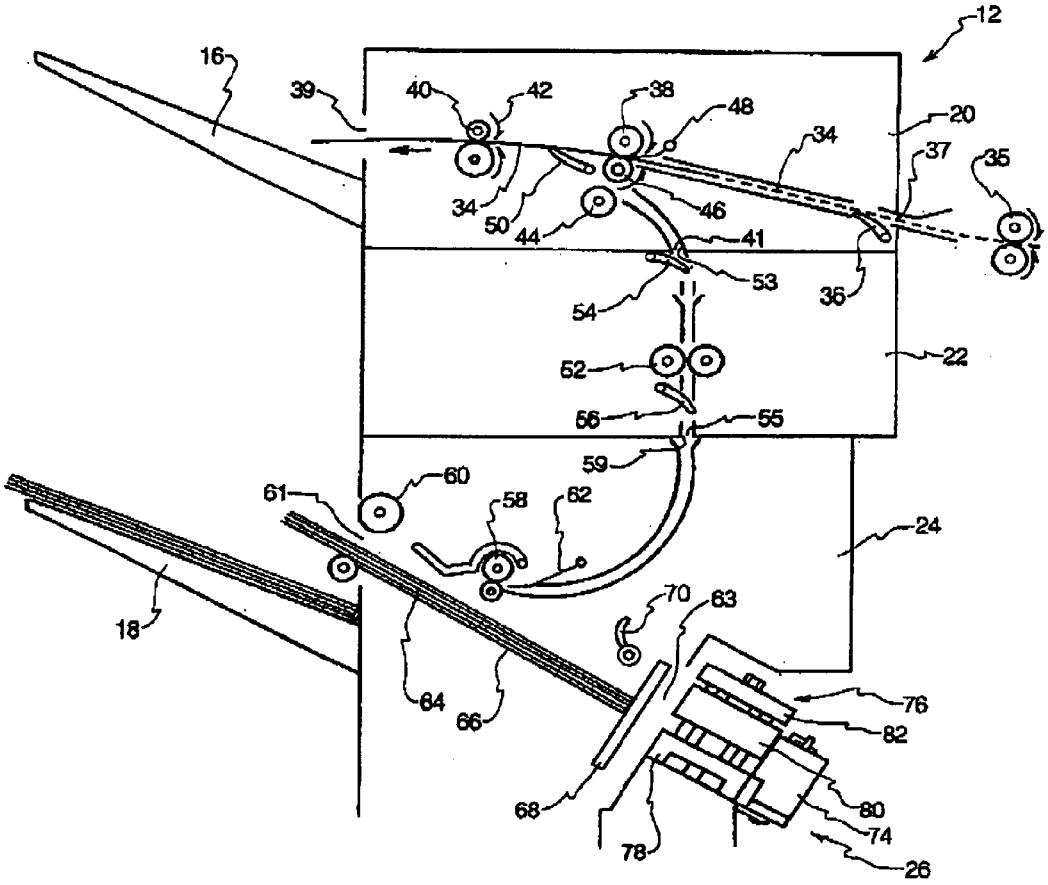
FIGS. 3–10 are side elevation views showing the routing of media sheets through the stacker of FIG. 2.
Figure 8:
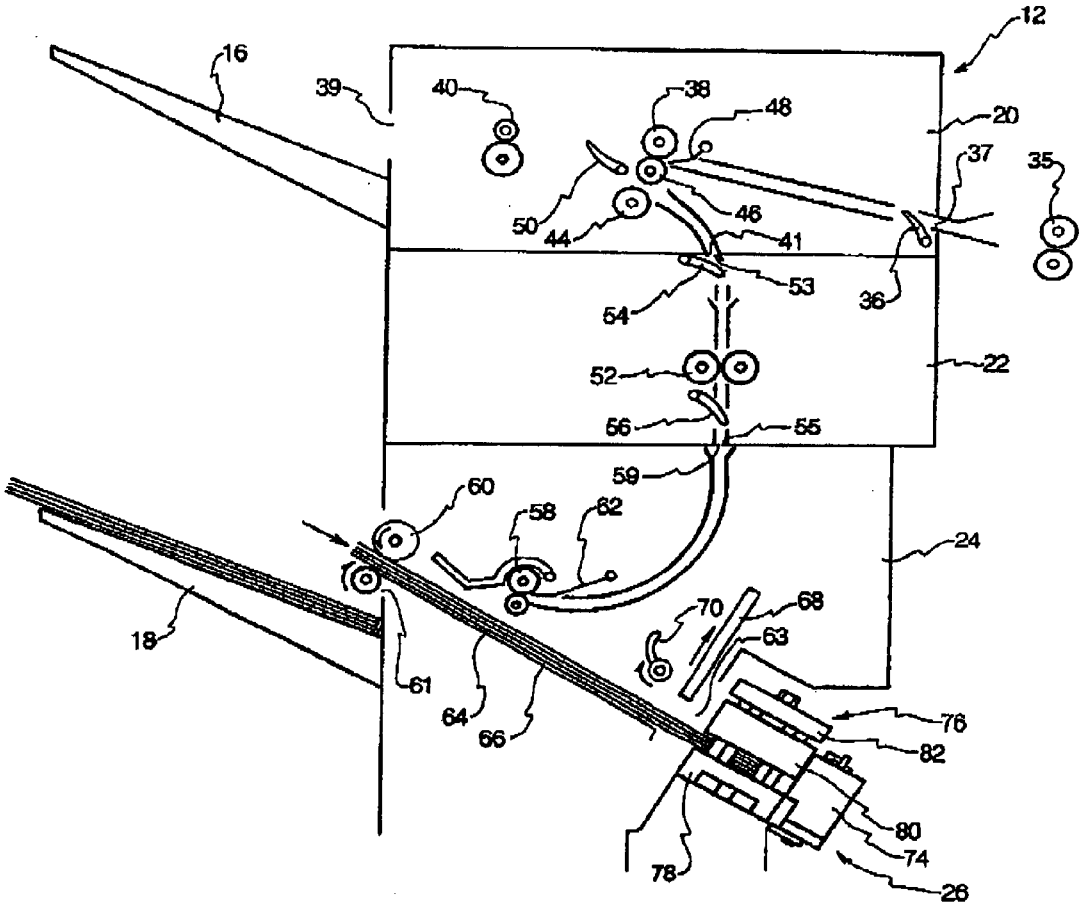
Figure 9:
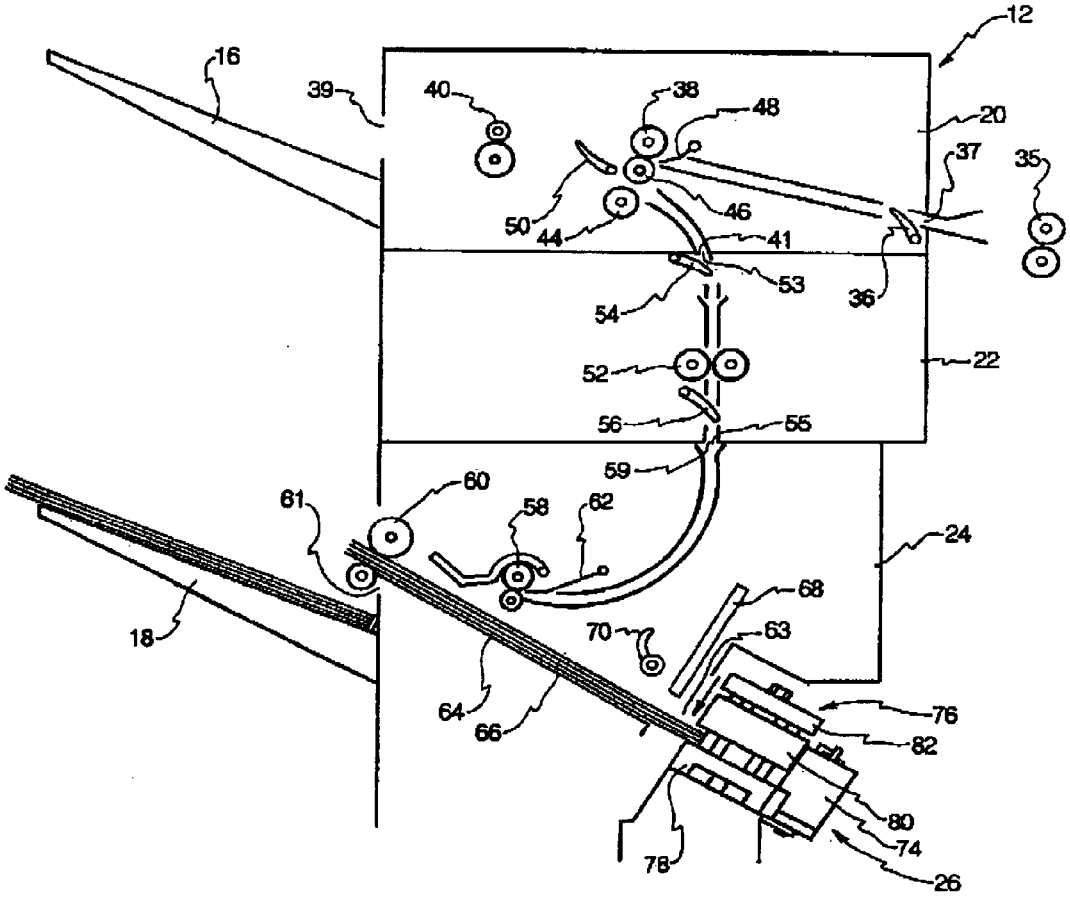
Figure 10:
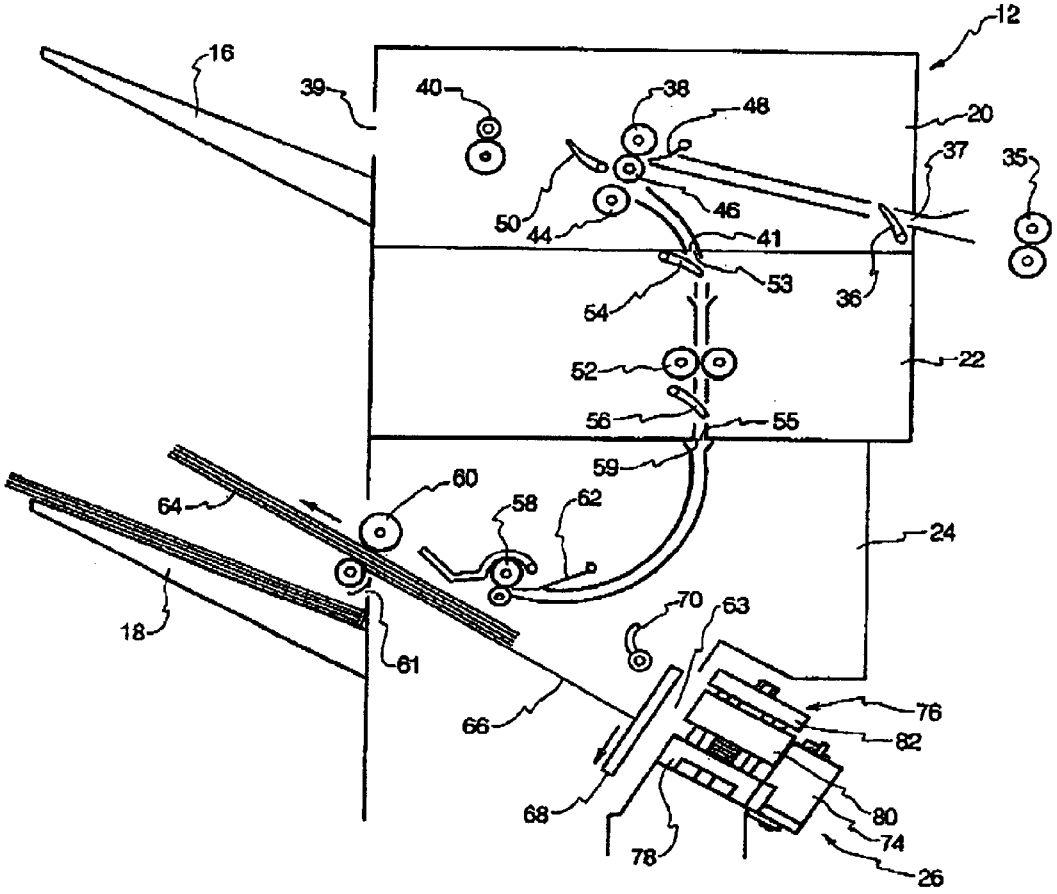

The operation of flipper 20, paper path 22, accumulator 24 and binder 26 will now be described in more detail with reference to FIGS. 3–10. FIG. 3 shows a sheet routed to loose sheet bin 16. FIGS. 4–7 show a sheet routed to accumulator 24 in preparation for binding. FIGS. 8–10 show the stack routed to binder 26, bound and then ejected to stacker bin 18.

Referring to FIG. 3, a sheet of paper or other print media 34 is output by printer 10 to stacker 12 through printer output rollers 35 and received into flipper 20 through flipper receiving port 37. As flipper entry sensor 36 detects sheet 34 entering flipper 20, flipper entry rollers 38 and flipper tray rollers 40 are driven forward as indicated by arrows 42 to move sheet 34 toward bin 16. For sheets routed to loose sheet bin 16 through flipper discharge port 39, rollers 38 and 40 are continually driven forward until sheet 34 reaches bin 16. In the embodiment shown in the Figures, flipper entry rollers 38 and flipper out rollers 44 share the same drive roller 46. Drive roller 46 is movable up or down to engage an opposing idler roller as necessary to move sheet 34 along one of two desired paper paths, as best seen by comparing FIGS. 3 and 4.

Figure 4:
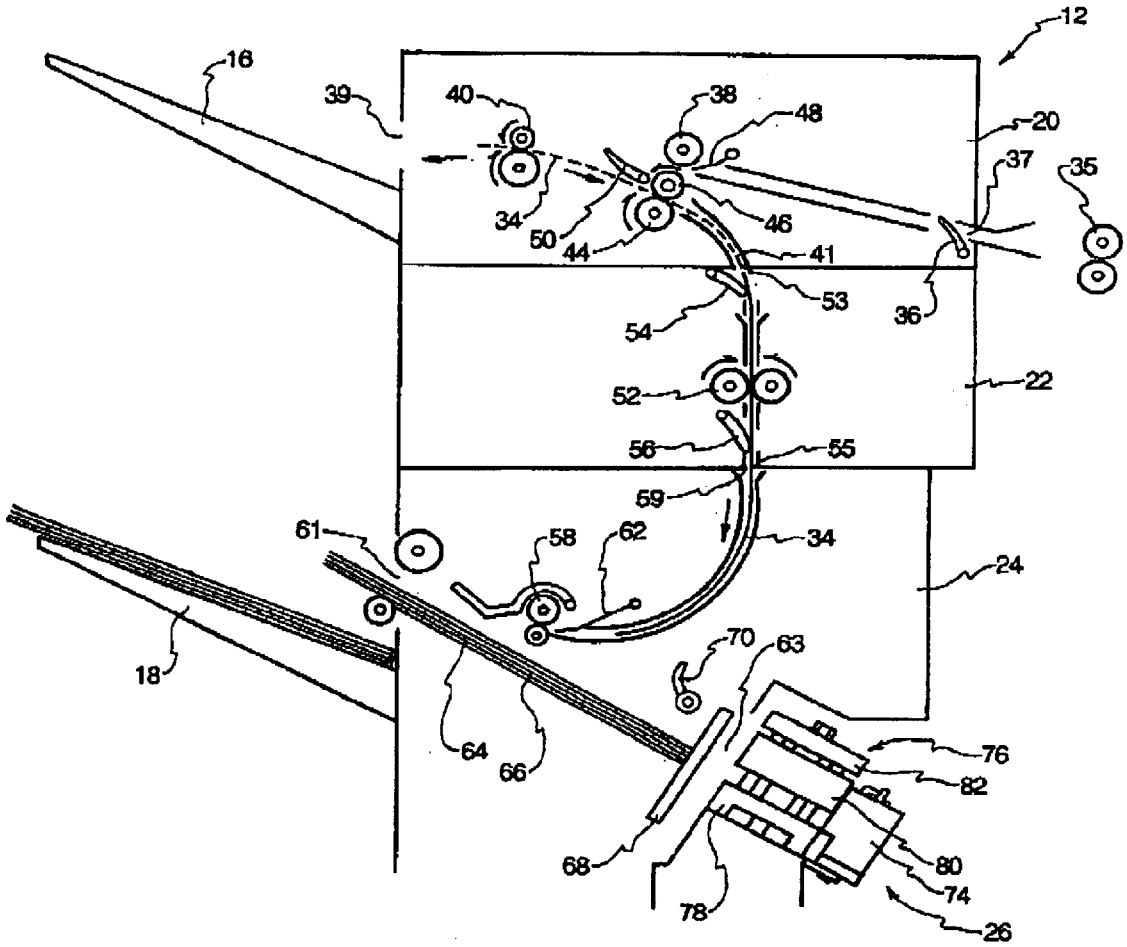

Referring now to FIG. 4, for sheets routed to accumulator 24, flipper entry and tray rollers 38 and 40 are driven forward until just after the trailing edge of sheet 34 clears flipper entry rollers 38, as detected by flipper middle sensor 48, such that the trailing edge of sheet 34 clears directional guide 50. Then, drive roller 46 is moved down to flipper out roller 44 and reversed along with flipper tray rollers 40 to route sheet 34 toward paper path 22 through flipper routing port 41 and paper path receiving port 53. Paper path rollers 52 move sheet 34 through paper path 22 down to accumulator 24. Flipper exit sensor 54 detects when sheet 34 has cleared the flipper module 20. Paper path exit sensor 56 detects when sheet 34 has cleared the paper path module 22 through paper path discharge port 55. Exit sensors 54 and 56 are used to control paper path rollers 52. When paper path exit sensor 56 detects that sheet 34 is leaving the paper path module 22, then paper path rollers 52 are stopped unless another sheet has cleared the flipper module 20 as detected by flipper exit sensor 54.

Figure 5:
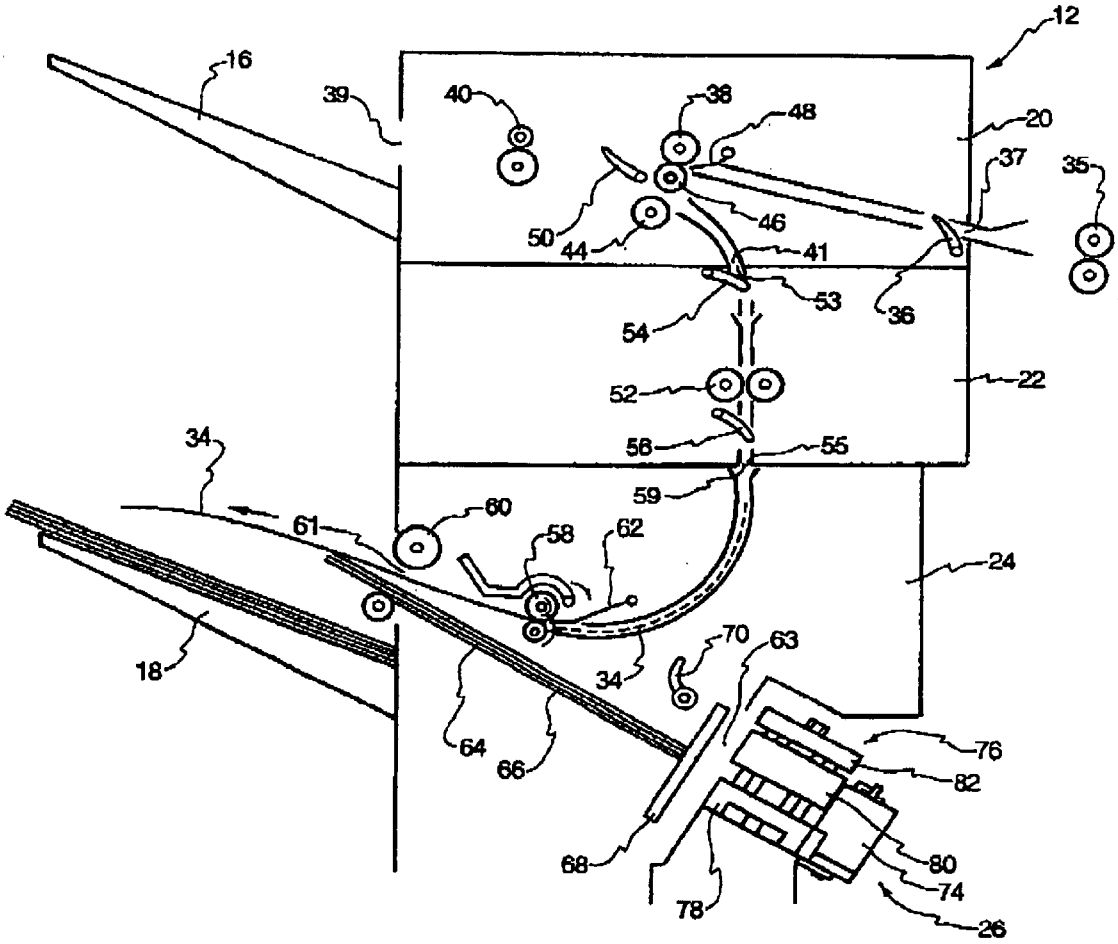
Figure 6:
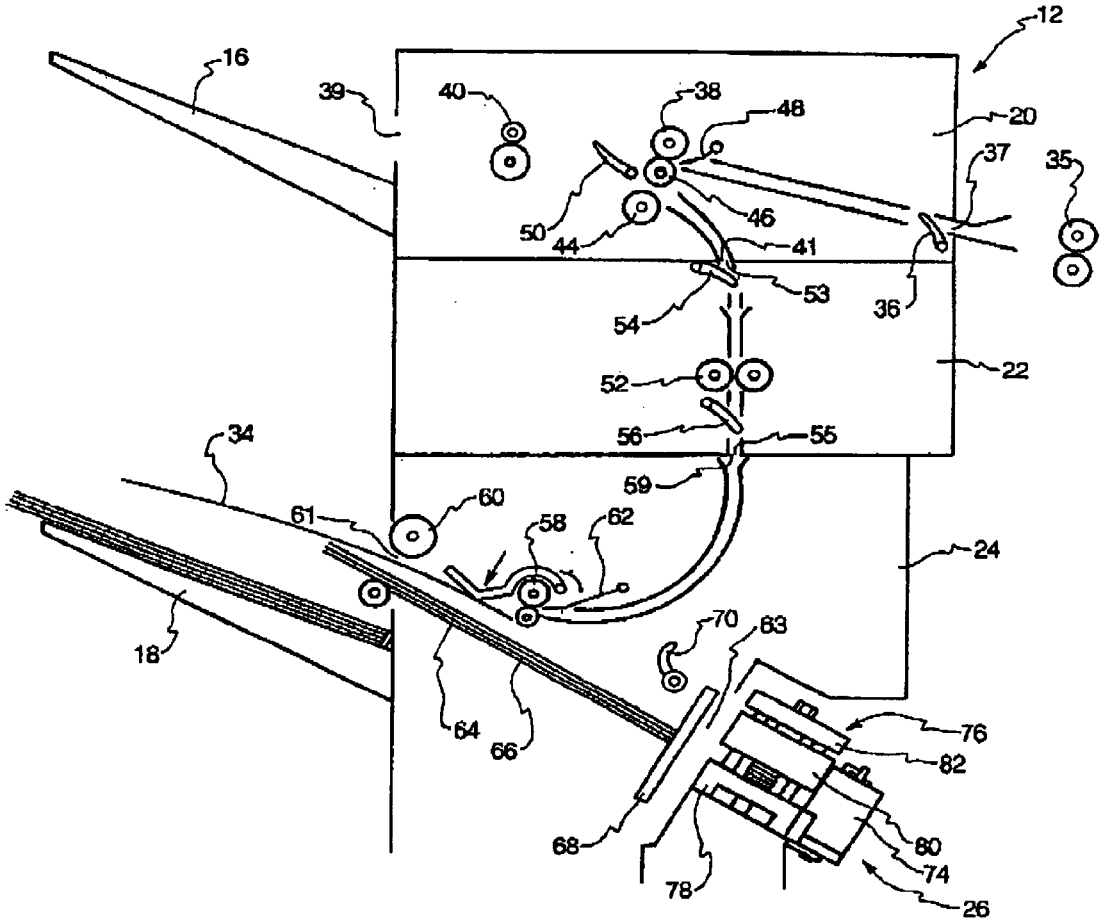
Figure 7:
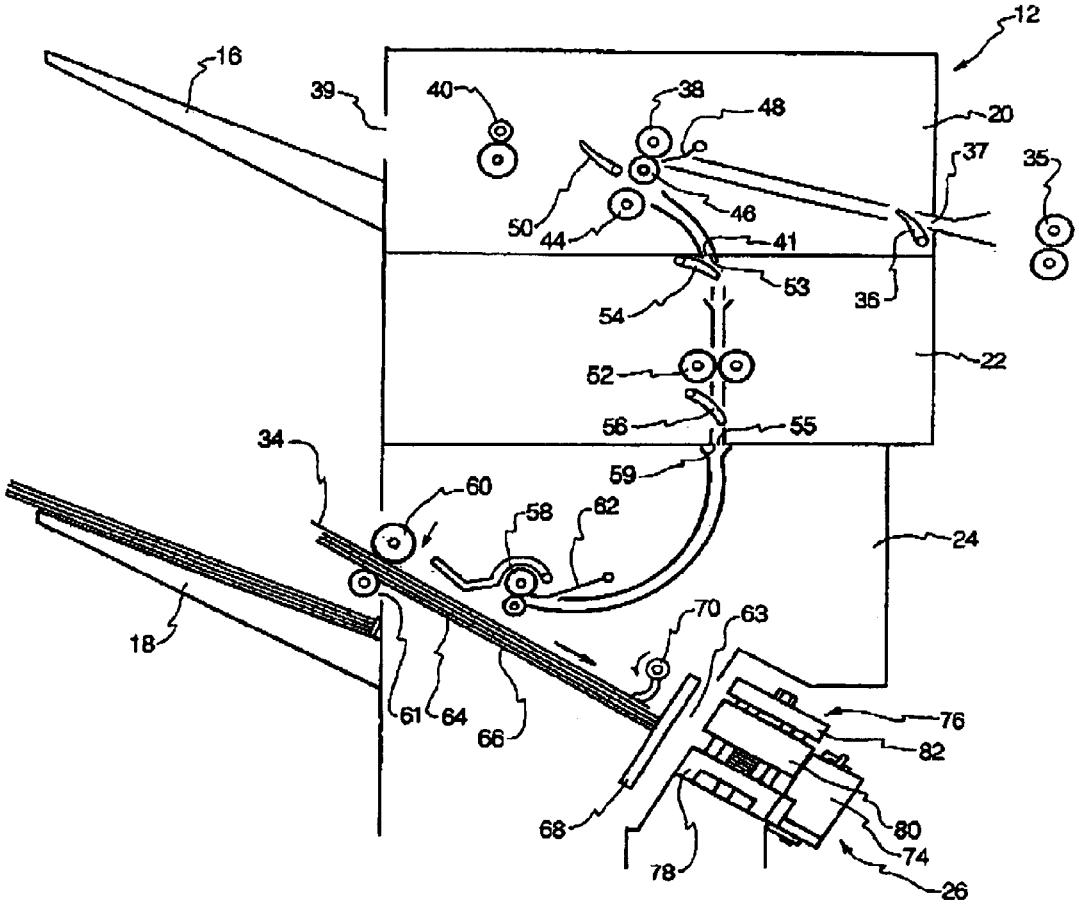

Referring to FIGS. 5–7, sheet 34 is guided down from accumulator receiving port 59 through accumulator 24 to accumulator entry rollers 58 and on to accumulator eject rollers 60. An accumulator entry sensor 62 is positioned immediately upstream from entry rollers 58. As the trailing edge of sheet 34 passes through entry rollers 58, as detected by entry sensor 62, eject rollers 60 move the top sheet 34 back on to stack 64 in accumulator holding tray 66, as best seen by comparing FIGS. 5, 6 and 7. In the embodiment shown in the Figures, eject rollers 60 are configured as a pair of variably spaced rollers that are selectively driven as necessary to move top sheet 34 or stack 64. As shown in FIGS. 5 and 6, eject rollers 60 are spaced apart or "open"to receive top sheet 34. Then, the rollers come together and the top roller is driven counter-clockwise to move top sheet 34 on to stack 64, as shown in FIG. 7. Eject rollers 60 are driven together, as shown in FIGS. 8 and 10, counter-clockwise to move stack 64 into binder 26 (FIG. 8) or clockwise to move stack 64 into lower output bin 18 (FIG. 10). Although not shown, at the same time each sheet 34 is routed to holding tray 66, sheet 34 is aligned with the other sheets in stack 66.

A binding operation will now be described with reference to FIGS. 8–14. Referring to FIG. 8, once all the sheets in the document are accumulated in stack 64, eject rollers 60 draw stack 64 back slightly from registration wall 68, registration wall 68 is moved up and eject rollers 60 are reversed to move the edge of stack 64 into binder 26 through accumulator binding port 63. Retainer 70 is then lowered against stack 64 to hold stack 64 in position during binding.

Figure 11:
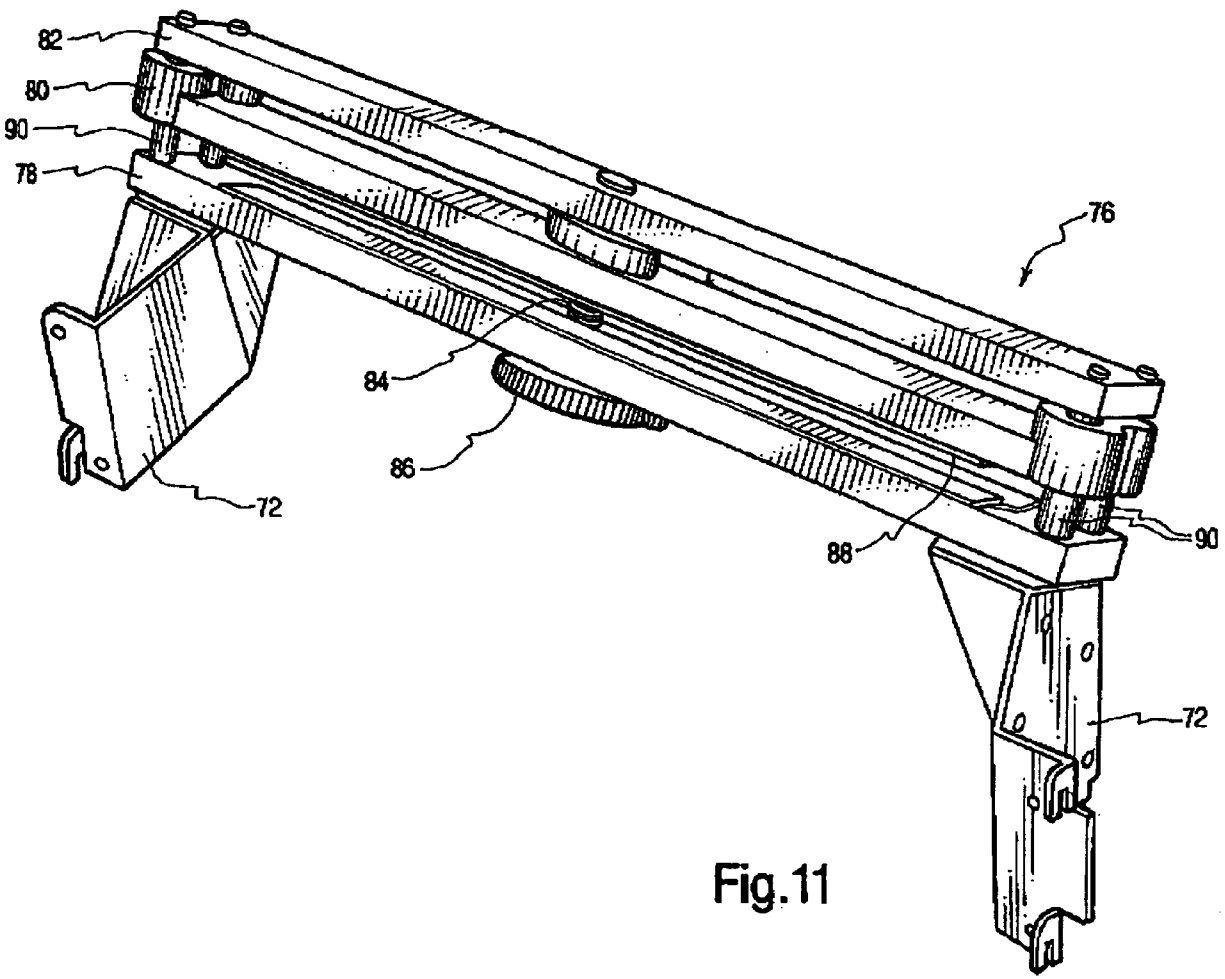
FIG. 11 is a detailed perspective view of an embodiment of the binder module according to the present invention.

Referring now also to FIG. 11, binder 26 includes mounting brackets 72, reversible motor 74 (not shown in FIG. 11) and press 76. Press 76 includes base or platen 78, carriage 80, top support plate 82, lead screw 84 and gear 86. Motor 74 is operatively connected to carriage 80 through gear 86 and lead screw 84. Carriage 80 moves alternately toward and away from platen 78 along guide posts 90 at the urging of motor 74.

Platen 78 and carriage 80, which also serves as a binder platen, form an opening immediately adjacent to accumulator holding tray 66. Preferably, holding tray 66 and base 78 and carriage 80, which also serves as a platen, are aligned at substantially the same angle to allow stack 64 to move easily into the opening between platens 78 and 80. Once the edge of stack 64 is positioned in binder 26, motor 74 is energized to close press 76 by driving carriage 80 against stack 64 and platen 78, as shown in FIG. 9. Pressure is thereby applied to the stack 64 and the binding operation is performed. Motor 74 is then reversed to open press 76 by driving carriage 80 away from stack 64 and platen 78. Press 76 is raised off the now bound stack 64, ejector rollers 60 are reversed again to route the bound stack 64 through accumulator discharge port 61 to stacker bin 18, and registration wall 68 is raised in preparation for stacking the next print job, as shown in FIG. 10.

Figure 12:
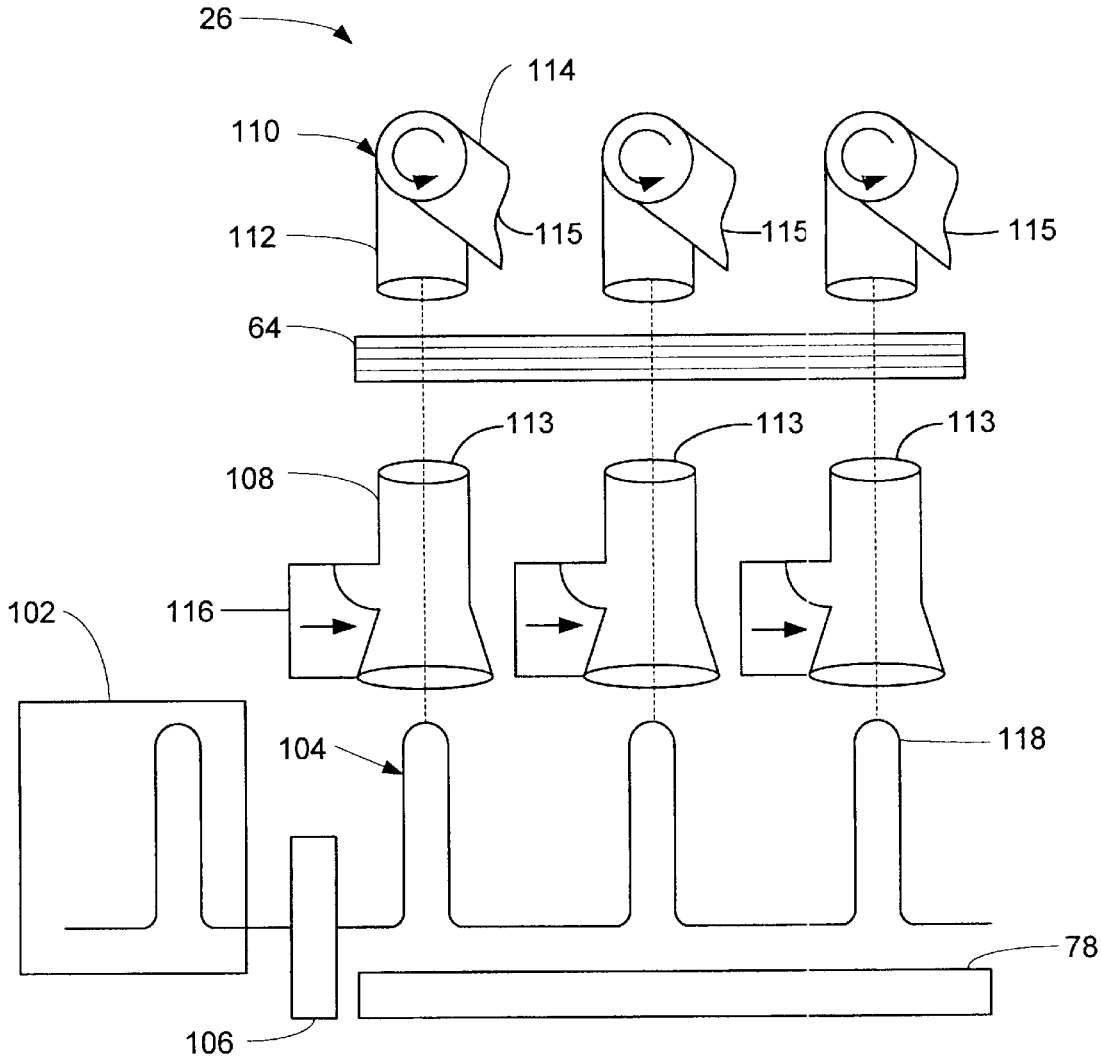
FIG. 12 illustrates the operation of the spiral binder in accordance with the present invention.
Figure 13:
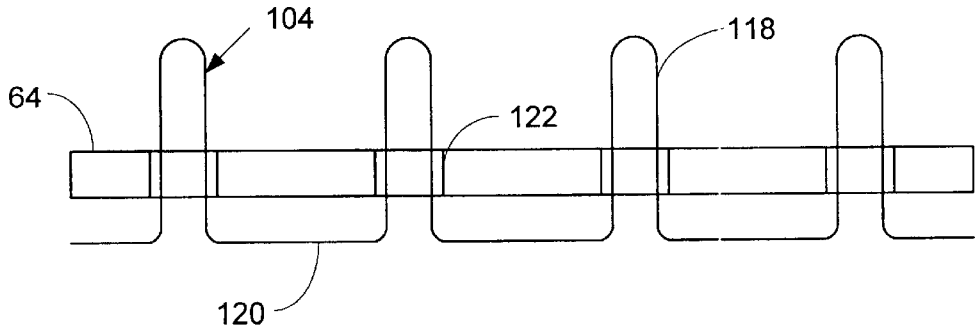
FIG. 13 illustrates an embodiment of placement of the wire that serves as the spiral binder within a sheet stack in accordance with the present invention.

FIGS. 12–14 illustrate an exemplary embodiment of the spiral binder 26 and its method of mechanical and automated operation in accordance with the present invention. Spiral binder includes a wire dispenser 102 to dispense a wire element 104 that serves as the spiral binding element. A wire cutter 106 is utilized to cut wire element 104 to a selected length that is long enough to provide a suitable spiral binder for stack 64. Alternatively, the wire element 104 can be precut to a desired length so that the cutting step may be omitted. Wire dispenser 102 draws wire element 104 using either hooks or a magnetic catch. Other wire transport systems are also contemplated.

Spiral binder 26 further includes a plurality of bottom wire benders 108 and a plurality of top wire benders 110. Each wire bender 108 and 110 includes a hole punch portion 113 and 112, respectively, which, when urged together, punch a hole through stack 64 where the wire element is to be inserted. The hole punches 112 and 113 are removed from the stack 64 after the holes 122 are formed and moved sufficiently laterally away from the holes so that wire element 104 can be inserted into holes 122 without interference. The dashed lines show the alignment of hole punches 112 and 113 in performing the hole punch step and how wire element 104 is aligned for insertion into holes 122. Alternatively, the holes in the media sheets may be pre-punched, thus allowing the hole punch step to be omitted.

Each top wire bender 110 further includes a wire bending cam 114, which pivots about an axis and includes a rolling surface 115 that engages the wire while pivoting so as to cause the wire element to curve about itself. Each bottom wire bender 108 includes a bending anvil 116, which pivots about an axis so as to engage the bottom portion of the wire element and bend it in a generally curved manner to meet the tips of the bent top wire portion. The method of bending wire element 104 is not limited to the use of cams 114 and anvils 116, but can also be performed by mechanical fingers that hook the ends 118 and bend the wire in a spiral fashion. What is important is that the mechanism for bending wire

104 operates to provide a uniform spiral shape as well as close the ends sufficiently so as to prevent the sheets in the stack from coming loose.

During the binding step, also known as the bending step, cams 114 are rotated by a mechanical device such as a directly coupled drive shaft that rotates, a camshaft, hydraulic or piston drive, or pulleys. Anvils 116 are rotated via a press or a mechanical device such as a direct drive shaft, camshaft, hydraulic or piston drive, or pulleys.

Figure 14A:
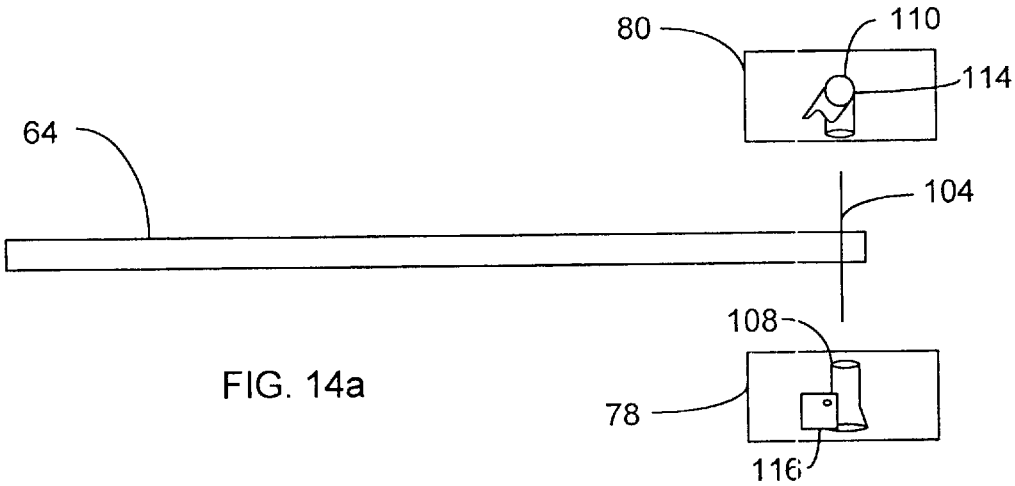
FIGS. 14*a* and 14*b* illustrate embodiments of the operation of achieving a spiral binder in accordance with the present invention.
Figure 14B:
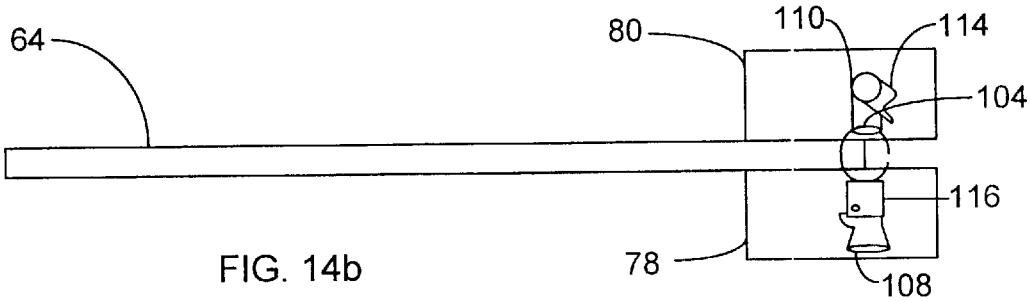

After the holes are punched, and as illustrated in FIGS. 13, 14*a* and 14*b*, platens 78 and 80 press towards stack 64 to hold it in place and to cause wire element 104 to guide through holes 122. Wire element 104 is inserted sufficiently so that top wire portions 118 can engage and be bent by cams 114 and bottom wire portions 120 can engage and be bent by anvils 116. Wire benders 108 and 110 can be moved relative to the inserted wire element to facilitate cams 114 and anvils 116 properly engaging wire portions 118 and 120, respectively. Alternatively, only the top or bottom wire portions need be bent, instead of both. In such an operation, the wire portion being bent must be closed sufficiently close to the opposite portion so that the sheets within the stack 64 cannot come loose.

Once the wire is in place, cams 114 and anvils 116 are rotated by their drive mechanisms to cause top wire portion 118 and bottom wire portion 120 to close together forming a circular or spiral binding. Cams 114 and anvils 116 move about their axis from a first position as shown in FIG. 14*a* to a second position as shown in FIG. 14*b*. Cams 114 can pivot 360 degrees (see arrow in FIG. 12) to complete the bending of wire portion 118. After completion of the spiral binding step, the bound stack 64 is ejected via ejector rollers 60 to stacker bin 18.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

What is claimed is:

1. A post print finishing device, comprising:

an accumulator module downstream in a media path that accumulates a stack of sheets passing in the media path;

a binder module operatively coupled to the accumulator module to bind the stack of sheets with a spiral binding by inserting a binding element through holes in the stack of sheets and closing the binding element inserted through holes in the stack of sheets to form a spiral binding; and an output bin downstream in the media path from the accumulator module to receive the spiral bound stack from the accumulator.

2. The invention according to claim further comprising a flipper module operative to receive a sheet leading edge first and discharge the sheet trailing edge first and the accumulator module operative to stack sheets discharged from the flipper module, present the stack to the binder module for binding and discharge the bound stack to the output bin.

3. A post print finishing device, comprising:

a vertically oriented frame;

a first output bin mounted to the frame;

a sheet flipper mounted to the frame adjacent to the first output bin, the flipper having a receiving port through which a sheet is received into the flipper, a discharge port opposite the receiving port and adjacent to the first output bin through which a sheet is discharged to the first output bin, and a routing port through which a sheet is routed for further processing, the flipper configured to receive a sheet from a printing device and either discharge a sheet leading edge first to the first output bin or route a sheet trailing edge first through the routing port;

a second output bin mounted to the frame below the first output bin;

a sheet accumulator mounted to the frame below the flipper and adjacent to the second output bin, the accumulator having a receiving port through which sheets routed through the flipper routing port are received into the accumulator, a discharge port through which a stack of sheets is discharged to the second output bin, and a binding port through which a stack of sheets is moved for binding, the accumulator configured to accumulate sheets in a stack, move the stack back and forth through the binding port and discharge the stack to the second output bin through the discharge port; and a binder mounted to the frame, the binder having a wire dispenser, a pair of wire deforming means disposed opposite one another adjacent to the accumulator binding port, the wire deforming means movable between a first open position in which an edge of the stack of sheets in the accumulator may be inserted between the wire deforming means or withdrawn from between the wire deforming means and a second compressed positioned in which a portion of a wire element provided by the wire dispenser is inserted through openings in the edge of the stack and deformed by the pair of wire deforming means to form a spiral binding in the edge of the stack.

4. The device of claim 3, further comprising a media sheet path mounted to the frame between the flipper and the accumulator, the path having a receiving port adjacent to the flipper routing port for receiving a sheet into the path and a discharge port adjacent to the accumulator receiving port through which a sheet is discharged to the accumulator, the path configured to receive a sheet from the flipper and transport the sheet to the accumulator.

5. A post print finishing device, comprising:

a support structure having a base and uprights extending vertically from the base;

a first output bin mounted to the uprights;

a second output bin mounted to the uprights below the first output bin;

a first module mounted to the uprights adjacent to the first output bin;

a second module mounted to the uprights below the first module;

a third module mounted to the uprights below the second module and adjacent to the second output bin;

the first module having a first media path through which media sheets are output to the first output bin and a second media path through which media sheets are output to the second module;

the second module having a third media path through which media sheets are received from the first module, stacked, presented to the third module and output to the second output bin; and the third module having a binder comprising a wire dispenser, a wire cutter, coupled to the wire dispenser, a first wire deforming means, and a second wire deforming means operative with the first wire deforming means, the first wire deforming means movable between a first position in which the first wire deforming means is separated from media sheets presented by the second module and a second position in which the first wire deforming means compresses the media sheets and wherein a wire element is dispensed by the wire dispenser, cut by the wire cutter upon reaching a desired length, and placed in alignment with one edge of the media sheets, the wire element being partially inserted through openings formed along the one edge of the media sheets such that as the first wire deforming means is moved to the second position, the first wire deforming means and the second wire deforming means deform a portion of the wire element on opposite sides of the stack to form a spiral binding along the one edge.

6. The device of claim 5, further comprising a fourth module mounted to the uprights between the first and second modules, the fourth module having a fourth media path through which media sheets are received from the first module and output to the second module.

7. The device of claim 5, wherein the first wire deforming means further comprises a hole punch device used to punch holes along the one edge to receive a portion of the wire element.

8. The device of claim 5, wherein the first wire deforming means further comprises a first set of cams operable to deform a portion of the wire element in a first circular path and the second wire deforming means further comprises a set of anvils operable to deform a second portion of the wire element in a second circular path opposite in direction to the first circular path.

9. A document production system, comprising:

a printing device;

a post print finishing device operatively connected to the printing device, the finishing device comprising an accumulator module downstream in a media path from the printing device, a binder module operatively coupled to the accumulator module, the binder module operative to bind sheets in a stack by inserting a portion of a wire element through a common edge of the sheets and bending the wire element to bind the sheets in the stack with a spiral binding, and an output bin downstream in the media path from the accumulator module, and wherein the accumulator module operates to stack sheets discharged from the printing device, present the stack to the binder module for binding and discharge the bound stack to the output bin.

10. A document production system, comprising:

means for printing data on a sheet of media;

means for finishing the printed sheet, the means for finishing being operatively connected to the printing device and comprising means for accumulating a plurality of printed sheets of media from the printing means, means for spirally binding the accumulated plurality of printed sheets of media a stack by inserting a portion of a wire element through a common edge of the sheets and bending the wire element to bind the sheets in the stack with a spiral binding, and means for receiving the spirally bound sheets after being bound.

11. A method of finishing a document comprising:

printing information on a plurality of sheets of media;

mechanically accumulating the plurality of printed sheets of media in a stack, and mechanically binding the stack in an automated fashion by inserting a portion of a wire element through a common edge of the sheets and bending the wire element to bind the sheets in the stack with a spiral binding.

12. The method according to claim 11 further comprising the step of mechanically outputting the bound stack to an output bin.

* * * * *

UNITED STATES PATENT AND TRADEMARK OFFICE

CERTIFICATE OF CORRECTION

PATENT NO. : 6,739,818 B2
DATED : May 25, 2004
INVENTOR(S) : Jaime De La Torre Aguirre It is certified that error appears in the above-identified patent and that said Letters Patent is hereby corrected as shown below:

Column 1,
Line 9, delete "documented" and insert therefor -- document --

Column 5,
Line 62, after "claim" insert -- 1 --

Signed and Sealed this

Twenty-fifth Day of January, 2005

JON W. DUDAS
*Director of the United States Patent and Trademark Office*